US007832592B2

(12) United States Patent
Bodemann

(10) Patent No.: US 7,832,592 B2
(45) Date of Patent: Nov. 16, 2010

(54) BEVERAGE DISPENSING GAS CONSUMPTION DETECTION WITH ALARM AND BACKUP OPERATION

(75) Inventor: Timothy S. Bodemann, Raleigh, NC (US)

(73) Assignee: South-Tek Systems, Raleigh, NC (US)

( * ) Notice: Subject to any disclaimer, the term of this patent is extended or adjusted under 35 U.S.C. 154(b) by 1067 days.

(21) Appl. No.: 11/513,448

(22) Filed: Aug. 31, 2006

(65) Prior Publication Data

US 2006/0289559 A1 Dec. 28, 2006

Related U.S. Application Data

(63) Continuation-in-part of application No. 11/156,859, filed on Jun. 20, 2005.

(51) Int. Cl.
*B67D 1/00* (2006.01)

(52) U.S. Cl. ..... 222/53; 222/4; 222/23; 222/39; 222/61; 222/132; 222/135; 222/399

(58) Field of Classification Search ..... 222/4, 222/23, 39, 53, 59, 61, 396, 399, 129, 129.1, 222/129.2, 132, 129.4, 133, 134, 145.1, 135, 222/145.6

See application file for complete search history.

(56) References Cited

U.S. PATENT DOCUMENTS

| | | | | |
|---|---|---|---|---|
| 2,210,083 | A | | 8/1940 | Johnson |
| 2,633,959 | A | | 4/1953 | Von Stoeser |
| 3,472,425 | A | | 10/1969 | Booth et al. |
| 3,565,405 | A | | 2/1971 | Black |
| 3,567,387 | A | | 3/1971 | Jones |
| 3,611,981 | A | | 10/1971 | Warncke |
| 3,780,198 | A | * | 12/1973 | Pahl et al. ..... 426/477 |
| 3,785,333 | A | | 1/1974 | Warncke et al. |
| 3,851,520 | A | | 12/1974 | Schluter et al. |
| 3,937,194 | A | | 2/1976 | Tamaki et al. |
| 3,943,261 | A | | 3/1976 | Amon et al. |
| 3,952,740 | A | | 4/1976 | Scurlock |
| 3,967,635 | A | | 7/1976 | Sealfon et al. |
| 3,991,219 | A | | 11/1976 | Kuckens |
| 4,007,456 | A | | 2/1977 | Paige et al. |
| 4,064,899 | A | | 12/1977 | Lehmann |
| 4,100,537 | A | | 7/1978 | Carlson |
| 4,116,612 | A | | 9/1978 | Melgaard |
| 4,176,617 | A | | 12/1979 | Pilipski |
| 4,191,952 | A | | 3/1980 | Schreiber et al. |
| 4,203,099 | A | | 5/1980 | Edwards |
| 4,276,999 | A | | 7/1981 | Reichenberger |
| 4,304,736 | A | | 12/1981 | McMillin et al. |
| 4,350,115 | A | | 9/1982 | Pasternack |

(Continued)

*Primary Examiner*—Frederick C. Nicolas
(74) *Attorney, Agent, or Firm*—Coats & Bennett, P.L.L.C.

(57) ABSTRACT

A $CO_2$-based beverage dispensing system includes a $CO_2$ monitoring unit operative to emit a warning upon detecting excessive consumption of $CO_2$ gas. The $CO_2$ monitoring unit includes a gas input port, a gas output port, a $CO_2$ monitor, an alarm, and in one embodiment a shut-off valve. The $CO_2$ monitor may measure $CO_2$ gas flow rate or pressure, and indicate excessive $CO_2$ gas consumption if the measured $CO_2$ gas flow rate is above a predetermined flow rate or the measured $CO_2$ gas pressure is below a predetermined pressure level. The $CO_2$ monitor may include chronological functionality, and only indicate excessive $CO_2$ gas consumption if the measured quantity trips a threshold for a predetermined duration.

21 Claims, 2 Drawing Sheets

U.S. PATENT DOCUMENTS 4,364,413 A 12/1982 Bersin et al.
4,399,744 A 8/1983 Ogden
4,442,856 A 4/1984 Betz
4,457,303 A 7/1984 Durkan
4,487,155 A 12/1984 Olesen
4,502,842 A 3/1985 Currier et al.
4,537,038 A 8/1985 Alsenz et al.
4,550,726 A 11/1985 McEwen
4,607,342 A 8/1986 Seiden et al.
4,635,468 A 1/1987 Hickam et al.
4,656,933 A 4/1987 Aschberger et al.
4,665,809 A 5/1987 Aschberger et al.
4,669,415 A 6/1987 Boord
4,676,095 A 6/1987 Eberle et al.
4,708,827 A 11/1987 McMillin
4,729,495 A 3/1988 Aschberger et al.
4,761,639 A 8/1988 Pyke et al.
4,783,990 A 11/1988 Eberle et al.
4,808,346 A 2/1989 Strenger
4,825,802 A 5/1989 Le Bec
4,839,014 A 6/1989 Park et al.
4,866,594 A * 9/1989 David et al. ..... 700/9
4,881,948 A * 11/1989 Nakane et al. ..... 48/192
4,916,437 A * 4/1990 Gazzaz ..... 340/632
4,989,160 A 1/1991 Garrett et al.
4,990,057 A 2/1991 Rollins
4,994,117 A 2/1991 Fehder
4,997,012 A 3/1991 Kuzow
5,011,700 A 4/1991 Gustafson et al.
5,068,116 A 11/1991 Gibney et al.
5,102,627 A 4/1992 Plester
5,165,397 A 11/1992 Arp
5,188,257 A 2/1993 Plester
5,270,069 A 12/1993 Plester
5,276,434 A 1/1994 Brooks et al.
5,314,703 A 5/1994 Gibney et al.
5,357,781 A 10/1994 Tikijian
5,419,358 A 5/1995 Sun
5,537,914 A 7/1996 Gibney et al.
5,538,746 A 7/1996 Levy
5,552,171 A 9/1996 Gibney et al.
5,553,749 A 9/1996 Oyler et al.
5,554,976 A 9/1996 Miyauchi et al.
5,639,224 A 6/1997 Schlossarczyk
5,649,577 A 7/1997 Farkas
5,694,118 A 12/1997 Park et al.
5,807,098 A 9/1998 Deng
5,988,859 A 11/1999 Kirk
6,067,022 A 5/2000 Laswick et al.
6,137,417 A 10/2000 McDermott
6,138,995 A * 10/2000 Page ..... 261/43
6,168,645 B1 1/2001 Succi et al.
6,251,243 B1 6/2001 Lindsay
6,312,589 B1 11/2001 Jarocki et al.
6,374,845 B1 4/2002 Melendez et al.
RE37,745 E 6/2002 Brandt et al.
6,474,325 B2 11/2002 Rice et al.
6,496,752 B2 12/2002 Sudolcan et al.
6,519,938 B1 2/2003 Foss
6,557,369 B1 5/2003 Phelps et al.
6,557,459 B1 5/2003 Phelps et al.
6,607,100 B2 8/2003 Phelps et al.
6,607,105 B2 8/2003 Phelps et al.
6,658,859 B2 12/2003 Phelps et al.
6,669,051 B1 12/2003 Phallen et al.
6,685,054 B2 2/2004 Kameyama
6,712,342 B2 3/2004 Bosko
6,856,251 B1 2/2005 Tietsworth et al.
6,925,852 B2 8/2005 Susko
6,986,263 B2 * 1/2006 Crisp, III ..... 62/389
6,992,590 B1 1/2006 Tietsworth et al.
7,013,905 B2 3/2006 Jones et al.
7,185,528 B2 3/2007 Bristol
7,288,276 B2 10/2007 Rona et al.
7,294,839 B2 11/2007 Rich et al.
7,340,966 B2 3/2008 DiMatteo et al.
7,356,381 B2 4/2008 Crisp, III
7,449,685 B2 11/2008 Takada et al.
7,481,237 B2 1/2009 Jones et al.
2001/0032036 A1 10/2001 Sudolcan et al.
2003/0213814 A1 11/2003 Phelps et al.
2006/0113322 A1 * 6/2006 Maser et al. ..... 222/129.1
2006/0208913 A1 9/2006 Christoffersen et al.
2007/0193653 A1 8/2007 Gagliano et al.
2007/0204930 A1 9/2007 Phallen et al.

* cited by examiner

BEVERAGE DISPENSING GAS CONSUMPTION DETECTION WITH ALARM AND BACKUP OPERATION

This application is a continuation-in-part application of U.S. patent application Ser. No. 11/156,859, filed Jun. 20, 2005, the disclosure of which is incorporated herein by reference.

BACKGROUND

The present invention relates generally to the field of beverage dispensing gas pressure systems and in particular to a system for detecting excessive $CO_2$ gas consumption, and emitting a warning of such.

Soft drinks dispensed from "soda fountains" are typically mixed in the dispenser. A carbonator generates carbonated water by mixing water and carbon dioxide ($CO_2$) under pressure. The carbonated water is mixed with syrup as it flows through the dispenser with the aid of $CO_2$ gas driven pump, into a cup. Bars, restaurants, convenience stores, and other businesses that sell soft drinks from a soda fountain maintain a tank of $CO_2$ gas, or in some cases a tank of liquid $CO_2$ (known as "Bulk Liquid" Storage), to provide $CO_2$ to the carbonator. In addition, many bars and restaurants use the pressurized $CO_2$ gas to drive beer and wine from kegs or other containers to be dispensed at taps. The $CO_2$ tank(s) and gas distribution system are typically leased from gas companies, who also refill the tanks as the $CO_2$ is depleted.

The gas companies set up regular "$CO_2$ fill" schedules for replenishing the $CO_2$ gas or liquid in the storage tanks. If the tank depletes prematurely—such as through a leak in a gas line or fitting, or if a tap to an empty beer keg is left open—the gas company must make an unscheduled service call to refill the tank(s). In some cases, these unscheduled service call represent up to ⅓ of the company's operating cost. If the cause of the service call is an open tap or other item that is clearly the fault of the lessee (i.e., the bar, restaurant, or store) the lessee is charged a penalty for the service call. If the cause of the leak is a malfunction or failure of the leased gas tank or distribution system, the cost of the service call must be absorbed by the gas company.

Automatic notification systems are known in the art that monitor $CO_2$ levels in the tanks, and use telemetry to notify the gas company when one or more $CO_2$ gas tanks are nearly empty. These systems are primarily used to create dynamic $CO_2$ fill schedules, so that service calls are only made when actually necessary. These systems function poorly to detect leaks or open taps, as they provide a warning only after one or more tanks are nearly empty. $CO_2$ gas detectors are known in the art that detect the presence of excessive $CO_2$ gas in a room. These detectors are primarily safety devices meant to avoid prolonged exposure to excessive $CO_2$ gas, which may result in oxygen deprivation. $CO_2$ gas detectors make poor leak or open tap detectors, as their effectiveness is highly dependent on detector placement, ambient air flow due to HVAC systems or open windows, and the like. In particular, $CO_2$ gas detectors may fail to detect relatively small leaks in an environment with adequate air circulation, even though over time the small leak may lose a significant amount of $CO_2$ gas from the system.

SUMMARY

In one embodiment, the present invention relates to a beverage dispensing system. The system includes a carbon dioxide ($CO_2$) gas source and a beverage dispenser connected in gas flow relationship to the $CO_2$ gas source, the beverage dispenser using $CO_2$ gas to dispense one or more beverages. The system additionally includes a $CO_2$ monitoring unit interposed between the $CO_2$ gas source and the beverage dispenser, the $CO_2$ monitoring unit including a $CO_2$ monitor operative to monitor the consumption of $CO_2$ gas, and an alarm operatively connected to the $CO_2$ monitor and operative to emit a warning if the $CO_2$ monitor indicates excessive $CO_2$ consumption. The system may additionally include an in-line shut-off valve.

In another embodiment, the present invention relates to a $CO_2$ monitoring unit for a beverage dispensing system. The $CO_2$ monitoring unit includes a gas input port operative to be connected to a $CO_2$ gas source and a gas output port operative to be connected to a beverage dispenser using $CO_2$ gas to dispense one or more beverages. The unit additionally includes a $CO_2$ monitor interposed between the gas input port and the gas output port, the $CO_2$ monitor operative to monitor the consumption of $CO_2$ gas, and an alarm operatively connected to the $CO_2$ monitor and operative to emit a warning if the $CO_2$ monitor indicates excessive $CO_2$ consumption. The monitoring unit may additionally include an in-line shut-off valve.

Figure two is a functional block diagram of a $CO_2$ monitoring unit.

DETAILED DESCRIPTION

Figure 1:
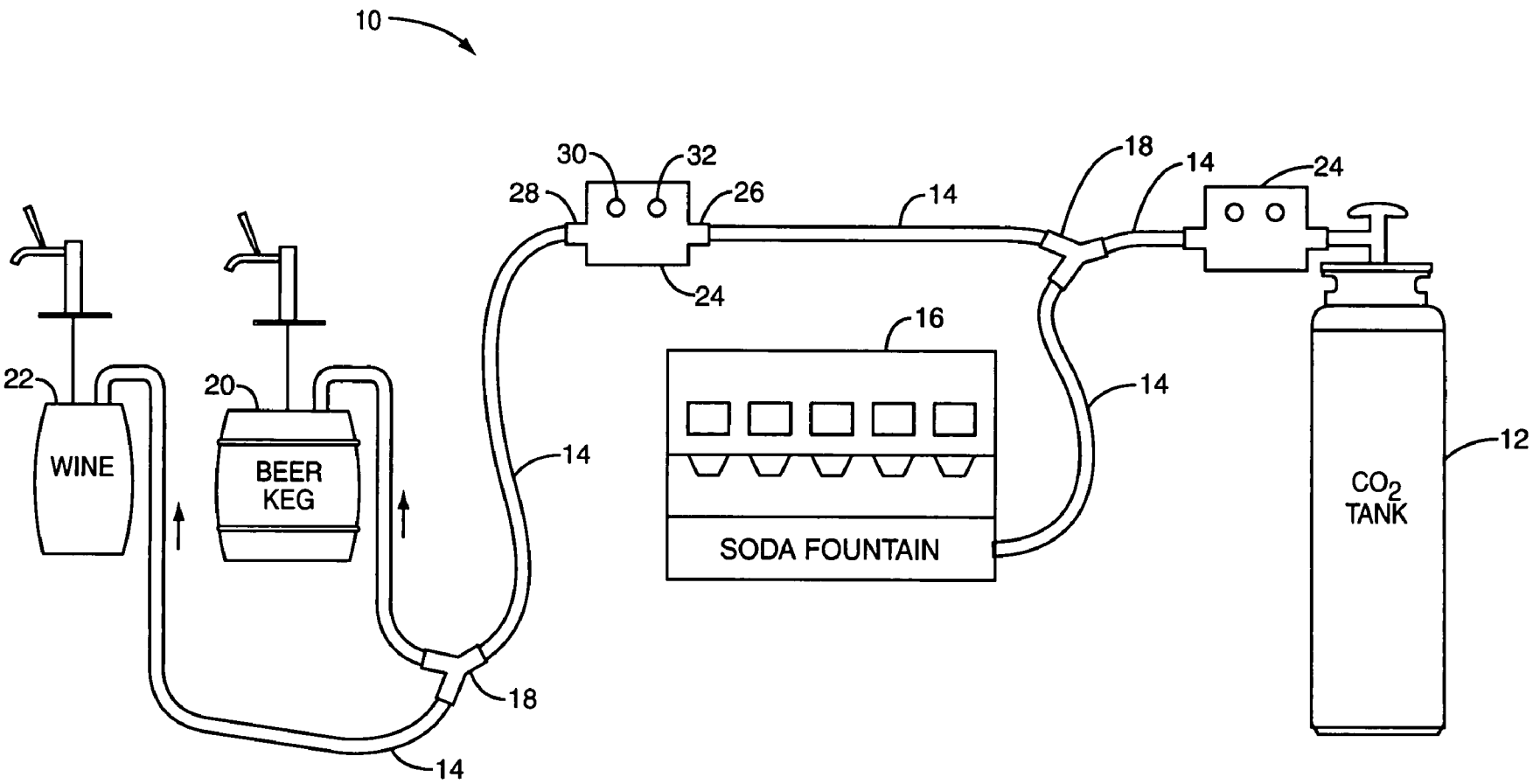
FIG. 1 is a functional block diagram of a $CO_2$-based beverage dispensing system.

FIG. 1 depicts a $CO_2$-based beverage dispensing system according to one or more embodiments of the present invention, indicated generally at 10. The system 10 includes a $CO_2$ source, such as $CO_2$ gas tank 12, and one or more beverage dispensers that use $CO_2$ gas to dispense beverages. The beverage dispensers may include a soda fountain 16 with an internal carbonator (not shown) to generate carbonated water, or a beer keg 20 or wine barrel 22, which use $CO_2$ gas pressure to drive beverages to dispensing taps, and use the $CO_2$ gas to displace the beverage in the container. $CO_2$ gas is transported from the $CO_2$ gas tank 12 to the beverage dispensers 16, 20, 22 in gas distribution lines 14. $CO_2$ gas is "tapped off" as necessary using "Y" splitters 18. Alternatively, a manifold may distribute $CO_2$ gas to a plurality of outputs, as required. Other elements commonly employed in beverage dispensing systems 10, such as shut-off valves, pressure gauges, and the like, are not necessary for an explanation of the present invention and are omitted from FIG. 1 for clarity.

Excessive consumption of $CO_2$ gas may result from improper fittings or punctures in one or more gas distribution lines 14 or couplers 18, or by malfunctioning CO2 gas driven pumps on the syrup injection system within the soda fountain system 16. Alternatively, or additionally, improper operation may cause excessive $CO_2$ gas consumption. For example, if a bartender leaves a tap connected to an empty keg 20 or barrel 22 in the open position, the $CO_2$ gas will flow freely, escaping into the air.

To detect excessive $CO_2$ gas consumption and issue a warning, one or more $CO_2$ monitoring units 24 are interposed between the $CO_2$ gas tank 12 and one or more beverage dispensers 16, 20, 22. A $CO_2$ monitoring unit 24 may be connected directly to the output of the $CO_2$ gas tank 12, or may be interposed along any gas distribution line 14. In one embodiment, the $CO_2$ monitoring unit 24 includes an in-line shut-off valve.

Figure 2:
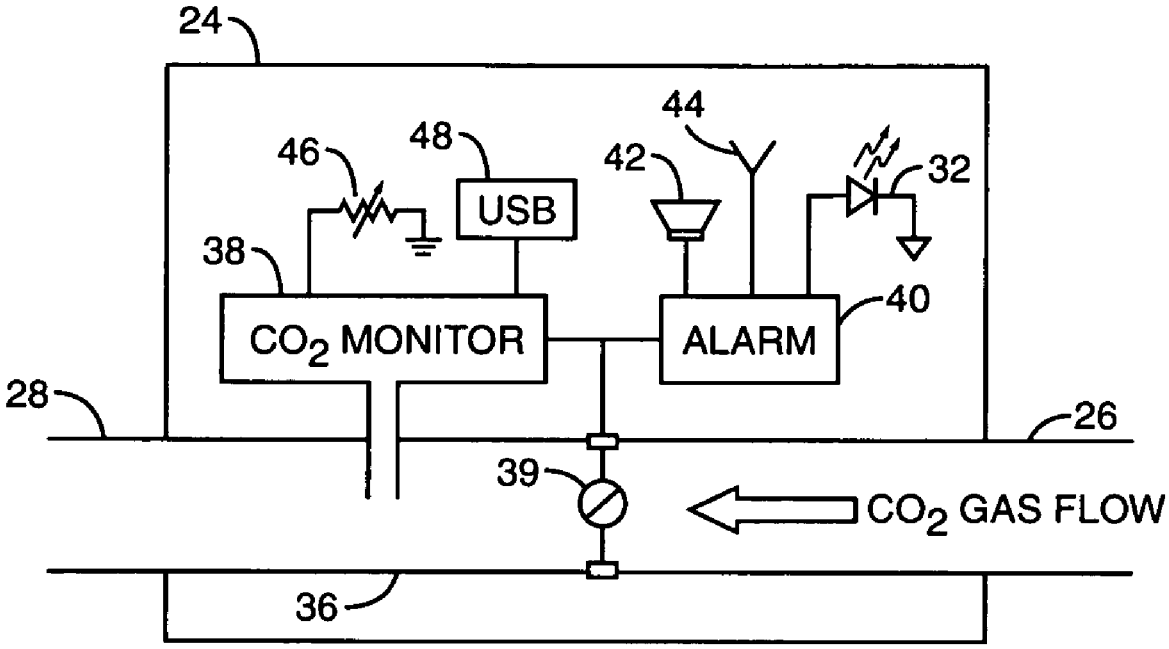

As depicted in FIG. 2, the $CO_2$ monitoring unit 24 includes a gas input port 26 and a gas output port 28, connected by a gas flow passage 36. Between the input port 26 and the output port 28, operatively connected to the gas flow passage 36, is a $CO_2$ monitor 38 that monitors properties of $CO_2$ gas flow to detect excessive $CO_2$ gas consumption. The $CO_2$ monitor 38 is operatively connected to an alarm 40 that emits a warning if the $CO_2$ monitor 38 detects excessive $CO_2$ gas consumption. The alarm signal output by the $CO_2$ monitor 38 may additionally actuate an in-line shut-off valve 39, cutting off the flow of $CO_2$ gas when excessive $CO_2$ gas consumption is detected.

In one embodiment, as depicted in FIG. 1, the $CO_2$ monitoring unit 24 includes output lights 30, 32 that provide a visual indication of the system 10 status, and a warning of excessive $CO_2$ gas consumption. The $CO_2$ monitor 38 may detect excessive $CO_2$ gas consumption in a variety of ways, and the alarm 40 may emit a warning of excessive $CO_2$ gas consumption in a variety of ways, as described herein.

In one embodiment, the $CO_2$ monitor 38 comprises a gas flow rate meter operative to measure the $CO_2$ gas flow rate from the gas input port 26 to the gas output port 28. The measured $CO_2$ gas flow rate is compared to a predetermined gas flow rate, and the alarm 40 emits a warning of excessive $CO_2$ gas consumption if the measured $CO_2$ gas flow rate exceeds the predetermined gas flow rate. In one embodiment, the predetermined gas flow rate is adjustable, and is preferably set to a value just above the flow rate of $CO_2$ gas in the system 10 when a few taps are dispensing beverages.

In another embodiment, the $CO_2$ monitor 38 additionally includes chronological functionality—that is, the ability to measure elapsed time. In this embodiment, the alarm 40 emits a warning of excessive $CO_2$ gas consumption only if the measured $CO_2$ gas flow rate exceeds a predetermined gas flow rate for a predetermined duration, e.g., 15 minutes. In this embodiment, a brief duration of unusually high $CO_2$ gas flow rate will not trigger a warning of excessive $CO_2$ gas consumption. This condition may occur, for example, if an empty keg 20 is changed without shutting off the gas distribution line 14 at the appropriate shut-off valve, or if a gas distribution line 14 comes loose from a coupling 18, and is discovered and quickly re-attached. However, a sustained high gas flow rate that exceeds the predetermined duration indicates a leak, open tap, or the like, for which a warning should be emitted to alert personnel of the problem, prompting a search for the leak or other corrective action to avoid further loss of $CO_2$ gas.

In one embodiment, the $CO_2$ monitor 38 comprises a gas flow detector operative detect gas flow, but not necessarily measure the gas flow rate. That is, the gas flow detector is operative to distinguish between any $CO_2$ gas flow from the gas input port 26 to the gas output port 28 and no $CO_2$ gas flow from the gas input port 26 to the gas output port 28. In this embodiment, the $CO_2$ monitor 38 also includes chronological functionality. The $CO_2$ monitor 38 indicates excessive $CO_2$ consumption upon detecting sustained $CO_2$ gas flow (at any flow rate) from the gas input port to the gas output port for a predetermined duration, e.g., two hours. In any beverage dispensing system 10, there will be at least brief periods between beverage dispensing operations when all taps and soda fountain dispensers 16 will be off, and no $CO_2$ gas should flow to beverage dispensers 16, 20, 22. In this embodiment, a warning of excessive $CO_2$ consumption is emitted if there is no "no flow" condition during the predetermined duration—that is, if $CO_2$ gas flows continuously through the $CO_2$ monitoring unit 24 for, e.g., two hours without interruption.

In one such embodiment, the state of the beverage dispensing system 10 is indicated by first and second output lights 30, 32. For example, the first output light 30 may comprise a green LED, and the second output light 32 a red LED (see FIG. 2). The green LED 30 is illuminated when the $CO_2$ monitor 38 detects gas flow through the $CO_2$ monitoring unit 24. The red LED 32 is illuminated when the $CO_2$ monitor 38 does not detect any gas flow through the $CO_2$ monitoring unit 24. If no "no flow" condition occurs over the predetermined duration, the alarm 40 emits a warning of excessive $CO_2$ consumption. In this case, the red LED 32 may flash, possibly in addition to another form of warning, such as sounding an audible alarm via speaker or buzzer 42.

In another embodiment, the $CO_2$ monitor 38 comprises a pressure monitor operative to detect the pressure of $CO_2$ gas in the gas flow passage 36. The detected $CO_2$ gas pressure is compared to a predetermined pressure level, and the alarm 40 emits a warning of excessive $CO_2$ gas consumption if the detected $CO_2$ gas pressure falls below the predetermined pressure level. The $CO_2$ gas pressure level in the beverage dispensing system 10 will drop slightly every time a tap is opened or the carbonator in the soda fountain 16 takes in more $CO_2$ gas. However, a leak or an open tap connected to an empty keg 20 or barrel 22 will cause a significant drop in pressure. Accordingly, the predetermined pressure level, which in one embodiment is adjustable, is preferably set to a value just below the normal system 10 operating pressure when a few taps are dispensing beverages.

In another embodiment, the $CO_2$ monitor 38 detecting gas pressure additionally includes chronological functionality. In this embodiment, the alarm 40 emits a warning of excessive $CO_2$ gas consumption only if the detected $CO_2$ gas pressure remains below the predetermined pressure level for a predetermined duration. In this embodiment, a brief but significant drop in $CO_2$ gas pressure will not trigger a warning of excessive $CO_2$ gas consumption. Such a pressure drop may occur, for example, when dispensing the last beverage from a keg 20 or barrel 22, and $CO_2$ gas flows freely through the tap following the last of the beverage, before an operator has time to close the tap.

In any of the embodiments described herein, if the $CO_2$ monitor 38 indicates excessive $CO_2$ gas consumption, the alarm 40 will issue a warning. In some embodiments, the alarm 40 is integrated with the $CO_2$ monitor 38 within the $CO_2$ monitoring unit 24, as depicted in FIG. 2. In other embodiments, the alarm 40 may be a separate unit, communicating with the $CO_2$ monitor 38 in the $CO_2$ monitoring unit 24 by a wired or wireless data link (not shown). In either case, the excessive $CO_2$ gas consumption warning may be audible, such as by driving a speaker or buzzer 42. Alternatively, or additionally, the warning may comprise a visual indicator, such as illuminating a steady or flashing light (incandescent or LED 32), displaying a warning message on a display panel (not shown), or the like. In one embodiment, the alarm may output a wired or wireless electronic signal to a data processing system such as a PC, a point of sale (POS) terminal system, or the like. In one embodiment, the alarm may initiate a wireless page or cellular call to a $CO_2$ leasing company, a $CO_2$ gas supplier, a service facility, the establishment's manager's cell phone, or the like, via antenna 44.

Upon noticing the warning issued by the alarm, a user or service technician may inspect the beverage dispensing system 10 for leaks or operator errors, and/or may initiate diagnostics testing. The manager of the establishment operating the beverage dispensing system 10 will be prompted to perform at least a cursory inspection of the system 10 upon noticing the excessive $CO_2$ gas consumption warning, since the establishment will be charged for a service call in the cause of the excessive $CO_2$ gas consumption is the fault of the establishment, such as an open tap.

In some embodiments, the predetermined threshold(s) of the $CO_2$ monitor 38 may be easily altered, for example, to the original predetermined gas flow rate threshold plus 10%, or the original predetermined gas pressure level minus 10%. This may allow an operator to account for transient, unusually heavy use of the beverage dispensing system 10 (such as during a sporting event or other occasion prompting a surge of beer sales).

In any of the embodiments described herein, predetermined threshold(s) of the $CO_2$ monitor 38 may be altered in a variety of ways. In one embodiment, a dial or set screw 46 may be provided on the $CO_2$ monitoring unit 24. An operator may calibrate the $CO_2$ monitoring unit 24 by turning the dial or set screw 46 to maximum sensitivity, dispensing beverages through a plurality of taps to cause the alarm 40 to emit a warning of excessive $CO_2$ gas consumption, and turning the dial or set screw 46 to lower sensitivity until the warning ceases. In another embodiment, the $CO_2$ monitoring unit 24 includes a computer interface, such as a USB port 48. Software provided with the $CO_2$ monitoring unit 24 guides a user through a calibration process, and sets the predetermined threshold(s). In this embodiment, the software may additionally perform extensive diagnostics on the $CO_2$ monitoring unit 24. In another embodiment, the predetermined threshold (s) of the $CO_2$ monitor are fixed.

By monitoring the consumption of $CO_2$ gas in a beverage dispensing system 10, the $CO_2$ monitoring unit 24 may alert users to excessive consumption of $CO_2$ gas. In one embodiment, the $CO_2$ monitoring unit 24 may additionally actuate an in-line shut-off valve to halt the flow of $CO_2$ gas. The shut-off valve may be reset when the leak is located and repaired. This may significantly reduce operating costs, both by postponing the need to purchase a new tank full of $CO_2$ gas, and by avoiding service fees associated with an unscheduled $CO_2$ fill by a gas provider.

Although the present invention has been described herein with respect to particular features, aspects and embodiments thereof, it will be apparent that numerous variations, modifications, and other embodiments are possible within the broad scope of the present invention, and accordingly, all variations, modifications and embodiments are to be regarded as being within the scope of the invention. In particular, while different embodiments of the various aspects of functionality have been individually described—e.g., excessive $CO_2$ gas consumption detection techniques, forms of warning, means for adjusting predetermined threshold(s), and the like—the present invention encompasses any and all permutations of these embodiments within any particular $CO_2$ monitoring unit 24. The present embodiments are therefore to be construed in all aspects as illustrative and not restrictive and all changes coming within the meaning and equivalency range of the appended claims are intended to be embraced therein.

What is claimed is:

1. A beverage dispensing system, comprising:

a carbon dioxide ($CO_2$) gas source;

a beverage dispenser connected in gas flow relationship to the $CO_2$ gas source, the beverage dispenser using $CO_2$ gas to dispense one or more beverages;

a $CO_2$ monitoring unit interposed between the $CO_2$ gas source and the beverage dispenser, the $CO_2$ monitoring unit including a $CO_2$ monitor operative to continuously monitor the rate of consumption of $CO_2$ gas; and an alarm operatively connected to the $CO_2$ monitor and operative to emit a warning if the $CO_2$ monitor indicates an excessive rate of $CO_2$ consumption.

2. The system of claim 1 wherein the $CO_2$ monitor is a gas flow rate meter operative to measure the $CO_2$ gas flow rate from the $CO_2$ gas source, the $CO_2$ monitor indicating an excessive rate of $CO_2$ consumption when the $CO_2$ gas flow rate exceeds a predetermined flow rate.

3. The system of claim 2 wherein the $CO_2$ monitor further includes chronological functionality, and wherein the $CO_2$ monitor indicates an excessive rate of $CO_2$ consumption upon measuring a sustained $CO_2$ gas flow rate in excess of a predetermined flow rate for a predetermined duration.

4. The system of claim 1 wherein the $CO_2$ monitor is a gas flow detector operative to distinguish between any $CO_2$ gas flow from the $CO_2$ gas source and no $CO_2$ gas flow from the $CO_2$ gas source, and further including chronological functionality, wherein the $CO_2$ monitor indicates an excessive rate of $CO_2$ consumption upon detecting sustained $CO_2$ gas flow from the $CO_2$ gas source for a predetermined duration.

5. The system of claim 1 wherein the $CO_2$ monitor is a pressure monitor operative to detect $CO_2$ gas pressure and having a chronological functionality, the $CO_2$ monitor indicating an excessive rate of $CO_2$ consumption when the detected $CO_2$ gas pressure remains below a predetermined level for a predetermined duration.

6. The system of claim 1 further comprising a shut-off valve operatively connected to the $CO_2$ monitor and operative to halt the flow of $CO_2$ gas in the system if the $CO_2$ monitor indicates an excessive rate of $CO_2$ consumption.

7. The system of claim 1 wherein the alarm warning is audible.

8. The system of claim 1 wherein the alarm warning is visible.

9. The system of claim 1 wherein the alarm warning is an electronic signal communicated to a data processing system.

10. The system of claim 1 where the alarm warning activates a wireless communication to a service facility.

11. A $CO_2$ monitoring unit for a beverage dispensing system, comprising:

a gas input port operative to be connected to a $CO_2$ gas source;

a gas output port operative to be connected to a beverage dispenser using $CO_2$ gas to dispense one or more beverages;

a $CO_2$ monitor interposed between the gas input port and the gas output port, the $CO_2$ monitor operative to continuously monitor the rate of consumption of $CO_2$ gas; and an alarm operatively connected to the $CO_2$ monitor and operative to emit a warning if the $CO_2$ monitor indicates an excessive rate of $CO_2$ consumption.

12. The $CO_2$ monitoring unit of claim 11 wherein the $CO_2$ monitor is a gas flow rate meter operative to measure the $CO_2$ gas flow rate from the gas input port to the gas output port, the $CO_2$ monitor indicating an excessive rate of $CO_2$ consumption when the $CO_2$ gas flow rate exceeds a predetermined flow rate.

13. The $CO_2$ monitoring unit of claim 12 wherein the $CO_2$ monitor further includes chronological functionality, and wherein the $CO_2$ monitor indicates an excessive rate of $CO_2$ consumption upon measuring a sustained $CO_2$ gas flow rate in excess of a predetermined flow rate for a predetermined duration.

14. The $CO_2$ monitoring unit of claim 11 wherein the $CO_2$ monitor is a gas flow detector operative to distinguish between any $CO_2$ gas flow from the gas input port to the gas output port and no $CO_2$ gas flow from the gas input port to the gas output port, and further including chronological functionality, wherein the $CO_2$ monitor indicates an excessive rate of $CO_2$ consumption upon detecting sustained $CO_2$ gas flow from the gas input port to the gas output port for a predetermined duration.

15. The $CO_2$ monitoring unit of claim 14 wherein the alarm comprises first and second output lights, the first light illuminated in response to the $CO_2$ monitor detecting gas flow from the gas input port to the gas output port, and the second light illuminated in response to the $CO_2$ monitor detecting no gas flow from the gas input port to the gas output port.

16. The $CO_2$ monitoring unit of claim 15 wherein the alarm warning comprises flashing the second output light in response to detecting no gas flow from the gas input port to the gas output port for a predetermined duration.

17. The $CO_2$ monitoring unit of claim 11 wherein the $CO_2$ monitor is a pressure monitor operative to detect $CO_2$ gas pressure and having chronological functionality, the $CO_2$ monitor indicating an excessive rate of $CO_2$ consumption when the detected $CO_2$ gas pressure falls below a predetermined level for a predetermined duration.

18. The $CO_2$ monitoring unit of claim 11 further comprising a shut-off valve operatively connected to the $CO_2$ monitor and operative to halt the flow of $CO_2$ gas through the monitoring unit if the $CO_2$ monitor indicates an excessive rate of $CO_2$ consumption.

19. The $CO_2$ monitoring unit of claim 11 wherein the alarm warning is audible.

20. The $CO_2$ monitoring unit of claim 11 wherein the alarm warning is an electronic signal communicated to a data processing system.

21. The $CO_2$ monitoring unit of claim 11 where the alarm warning activates a wireless communication to a service facility.

* * * * *